US005711687A

United States Patent [19]

Kuiper-Moore et al.

[11] Patent Number: 5,711,687

[45] Date of Patent: Jan. 27, 1998

[54] ELECTRICAL TERMINAL WITH LOCKING LANCE

[75] Inventors: David Bouwe Kuiper-Moore, London; Peter Donald Gaulton, Ickenham, both of Great Britain; Christian Otto Bömmel, Vilbel, Germany; Rolf Jetter, Darmstadt, Germany; Antonio Lehner, Wiesbaden, Germany

[73] Assignee: The Whitaker Corporation, Wilmington, Del.

[21] Appl. No.: 709,497

[22] Filed: Sep. 6, 1996

[30] Foreign Application Priority Data

| | | | |
|---|---|---|---|
| Sep. 12, 1995 | [GB] | United Kingdom | 9518620 |
| Sep. 12, 1995 | [GB] | United Kingdom | 9518621 |
| Sep. 12, 1995 | [GB] | United Kingdom | 9518628 |

[51] Int. Cl.[6] ..... H01R 13/434

[52] U.S. Cl. ..... 439/745

[58] Field of Search ..... 439/745–749, 439/879, 891, 839, 843–847

[56] References Cited

U.S. PATENT DOCUMENTS

| | | | |
|---|---|---|---|
| 3,178,674 | 4/1965 | Scheller | 439/748 |
| 4,540,235 | 9/1985 | Lolic | 339/259 F |
| 5,240,439 | 8/1993 | Egenolf | 439/745 |
| 5,399,110 | 3/1995 | Morello et al. | 439/879 |
| 5,609,505 | 3/1997 | Endo et al. | 439/886 |
| 5,611,716 | 3/1997 | Egenolf | 439/857 |
| 5,613,885 | 3/1997 | Plate et al. | 439/843 |

FOREIGN PATENT DOCUMENTS

| | | | |
|---|---|---|---|
| 2699010 | 6/1994 | France | 439/843 |
| 2220310 | 1/1990 | United Kingdom | 439/745 |

*Primary Examiner*—Gary F. Paumen
*Assistant Examiner*—Katrina Davis
*Attorney, Agent, or Firm*—Driscoll A. Nina

[57] ABSTRACT

A tab terminal comprises an inner contact body and an outer spring body having a locking lance. The outer body is mounted over the inner body in a vertical direction, whereby inwardly bent tabs of the inner contact body receive a side wall of the outer body, the other side wall of the outer body having a clinching tab that engages in a cutout of the inner contact body. The latter enables a very simple assembly procedure that reduces assembly time, tool complication, and therefore production costs.

6 Claims, 8 Drawing Sheets

ELECTRICAL TERMINAL WITH LOCKING LANCE

BACKGROUND OF THE INVENTION

1. Field of the Invention

This invention relates to an electrical terminal having a contact body, and an additional body with a locking lance mounted thereon.

2. Description of the Prior Art

Many electrical terminals are stamped and formed from sheet metal and comprise a connection section for connection to a complementary conductor such as a wire, a body section, and a contact section for mating with a complementary terminal. Certain terminals have resilient locking lances stamped from the body section for engaging with a shoulder of a connector housing cavity in order to retain the terminal in the housing. A locking lance which is stamped directly from the inner contact body may however not be sufficiently strong to support the required retention forces, or require a stronger and more resilient material to be used for the contact body. Resiliency and strength of the sheet metal however usually entails a material that is harder to stamp and form, and which is not well adapted for crimping connection to conducting wires. A compromise is usually sought between the need for good electrical and crimping properties, and the need for a strong and resilient material. A common means of overcoming this problem is by providing an additional outer body that is mounted around the body section of the inner contact body. The outer body may be produced of a material that has the required strength and resiliency for providing locking lances. Such terminals are generally more expensive to manufacture than single piece terminals, not only because of the need to stamp and form an additional part, but also because of the need to assemble the outer body over the inner body. Assembly of these parts is a significant cost driver in the manufacturing of two piece terminal, because the assembly cycle may take more than double the time than the stamping cycle. The assembly procedure also usually requires more complicated tooling which is not only more expensive, but also less reliable.

A typical way of mounting an outer body with locking lances, to an inner body, is to wrap the outer body around the inner body, usually by partially stamping the outer body and slipping it axially (in the direction of mating of the terminal) over the body section and then performing a final clinching or closing operation to affix the outer body to the inner body. This is a particularly time consuming and difficult operation.

SUMMARY OF THE INVENTION

It would therefore be desirable to provide a two part electrical terminal that is very cost-effective to manufacture, and in particular where the assembly procedure is simplified.

It is therefore an object of this invention to provide a two part electrical terminal that is cost-effective to manufacture, and in particular to assemble.

The objects of this invention have been achieved by providing an electrical terminal comprising an inner stamped and formed body having a connection section, a body section and a contact section for mating with a complementary terminal, further comprising an outer spring body having a resilient locking lance, the outer body comprising a base wall from which the locking lance is stamped, the base wall mountable against a top end of the inner contact body.

Further advantageous features of the invention are described in the description and claims.

BRIEF DESCRIPTION OF THE DRAWINGS

FIG. 23 is a top view of a fifth embodiment of a terminal according to this invention;

DETAILED DESCRIPTION OF THE PREFERRED EMBODIMENT

Figure 2:
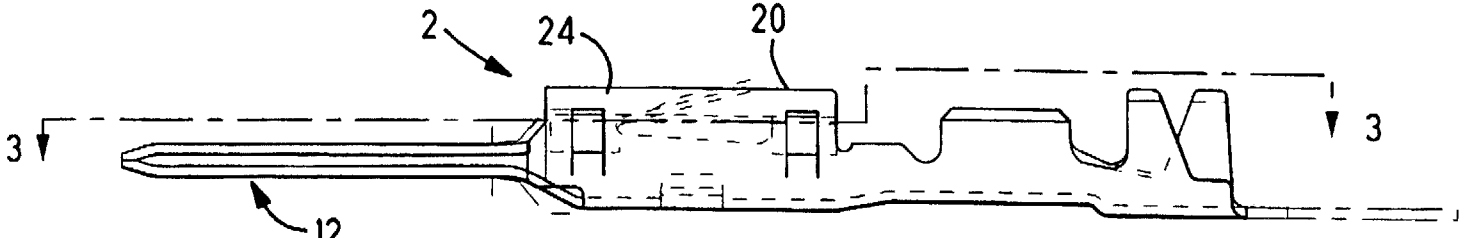
FIG. 2 is a view in the direction of arrow 2 of FIG. 1.
Figure 1:
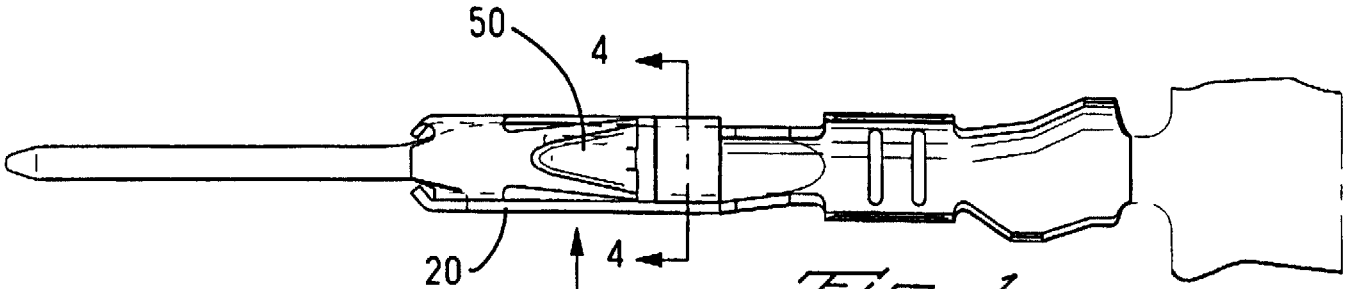
FIG. 1 is a top view of a terminal according to this invention.
Figure 3:
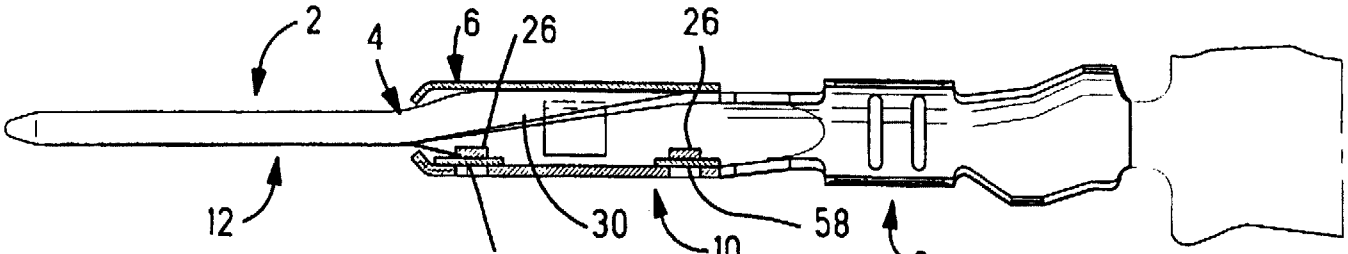
FIG. 3 is a cross-sectional view through lines 3—3 of FIG. 2.
Figure 4:
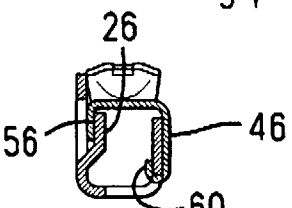
FIG. 4 is a cross-sectional view through lines 4—4 of FIG. 1.

Referring to FIGS. 1–5, an electrical terminal 2 comprises an inner contact body 4 and an outer body 6. The inner body 2 is stamped and formed from sheet metal and comprises a connection section 8 for crimping to a conducting wire, a body section 10 and a pin contact section 12 for mating with a complementary terminal.

Referring mainly to FIGS. 11–15, the body section 10 is substantially U-shaped and comprises a base wall 14 and side walls 16,18 extending upwardly from the base wall whereby one of the side walls 16 extends to a free end 20 that extends beyond the free end 22 of the opposing side wall, with respect to the base wall 14. This additional extension 24 provides on the one hand a means for polarizing the terminal with respect to a connector housing cavity for receiving the terminal, and on the other hand provides protection for a locking lance positioned on the outer body by preventing entanglement thereof with foreign objects such as wires. The side wall 16 further comprises a pair of inwardly stamped tabs 26 that have a wall portion 27 extending parallel to the side walls 16 to a top end 29 and spaced from the side wall by a gap G that is adapted to receive a wall of the outer body therein as will be explained hereinbelow.

The opposing side wall 18 has a top wall portion 30 extending progressively from a position proximate the connection section 8 towards the contact section 12, over the base wall 14 to provide a top wall 30 for extending into the contact section 12. The contact section 12 is substantially U-shaped having the top wall 32 extending through a U-bend 34, to a bottom wall 36 that extends from the base wall 14 of the body section. The contact section top and bottom walls 32,36 provide contact surfaces 37,38 that are on the plated surface of the sheet metal, rather than on the sheared edges, for electrical contact with complementary receptacle contacts thereagainst. The latter ensures good electrical contact, for situations where the mating contact has a specific orientation with respect to the terminal 2.

The base wall 14 is provided with a cutout 40 that extends into the side wall 18 and is for clinching of the outer body to the inner body.

Referring to FIGS. 6–9 and FIGS. 3–5, the outer body 6 comprises a top wall 44, a side wall 46 extending therefrom and a second side wall 48 parallel and opposed thereto also extending from the top wall. The outer body 6 is stamped and formed from a resilient sheet metal, such as stainless steel, which has the requisite strength and resiliency for providing a locking lance. A locking lance 50 is formed out of the top wall 44 and extends obliquely outwardly from an attachment portion 52 to a free end 54. The second side wall 48 comprises two spaced apart wall portions 56,58 that are for insertion into the gaps G of the corresponding tabs 26 of the inner contact body (see FIG. 13). The first wall 46 is mountable against an outer surface of the inner contact body wall 18, and comprises a clinching tab 60 extending below the wall for deformation into the inner contact body cutout 40.

Figure 5:
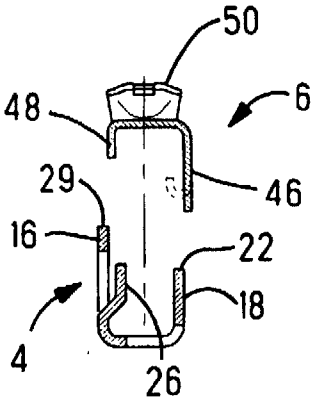
FIG. 5 is a similar view to that of FIG. 4 but with the outer spring body about to be assembled to the inner contact body.
Figures 11, 12, 13, 14, 15, 16:
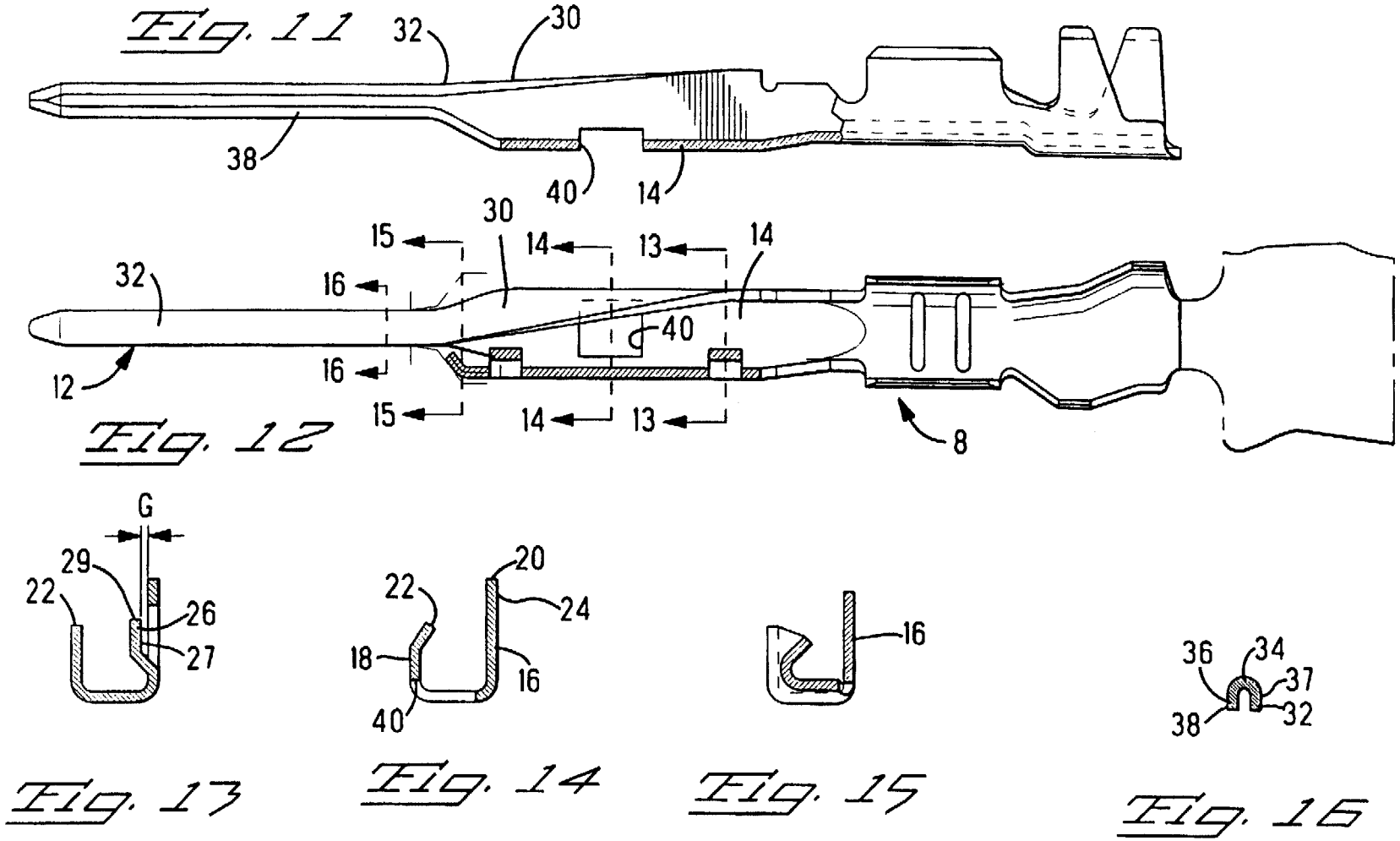
FIG. 11 is a partial cross-sectional side view of the inner contact body.
FIG. 12 is a partial cross-sectional top view of the inner contact body.
FIG. 13 is a cross-sectional view through lines 13—13 of FIG. 12.
FIG. 14 is a cross-sectional view through lines 14—14 of FIG. 12.
FIG. 15 is a cross-sectional view through lines 15—15 of FIG. 12.
FIG. 16 is a cross-sectional view through lines 16—16 of FIG. 12.

In order to assemble the outer body to the inner contact body, the pre-stamped and formed outer contact body is inserted from above, as shown in FIG. 5, over the top 30 of the inner contact body such that the wall portions 56,58 of the outer body are inserted into the gap G of the inner contact body tabs 26 until the top wall 44 abuts the free ends 22 and 29 of the inner contact body side wall 18 and tab 26 respectively (see FIG. 13). A forming tool can then be elevated from below the inner contact body base wall 14 to bend the outer contact body clinching tab 30 into the cutout 40. The latter assembly procedure is advantageous in that the assembly movement of the outer body is unidirectional and vertically above the inner body such that the strips of sheet metal of the inner and outer bodies by overlap in the assembly tool. As with the mounting of the outer body to the inner body in the vertical direction, clinching of the tab 60 can also be effected by vertical movement which enables provision of a more simple forming tool.

Figures 6, 7, 8, 9, 10:
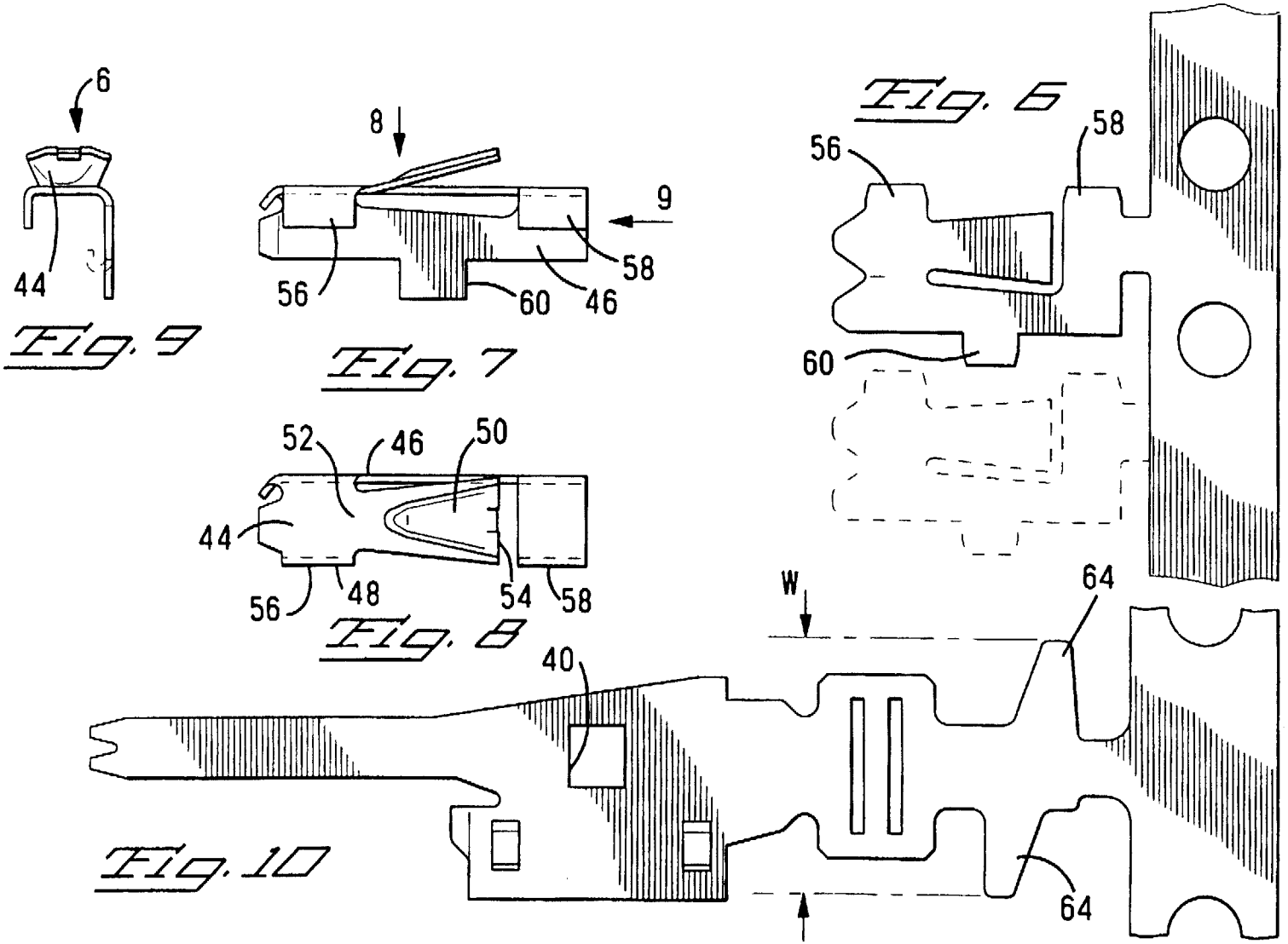
FIG. 6 is view of a partially stamped layout of the outer body.
FIG. 7 is a side view of the outer body.
FIG. 8 is a view in the direction of arrow 8 of FIG. 7.
FIG. 9 is a view in the direction of arrow 9 of FIG. 7.
FIG. 10 is a view of a partially stamped layout of the inner contact body.

Not only is the assembly procedure very simple, but the outer body requires less material than an outer body which is wrapped around the whole inner body. The inner contact body also makes effective use of material, as can be seen in the layout of FIG. 10, by restricting the width of the contact layout to that necessary for the wire crimping barrel arms 64. Also advantageous is the gradual bending over of the top wall 30 from the side wall 18 to extend into the contact section 12 which has a U-profile presenting plated contact surfaces 37,38 for mating against a complementary terminal.

Advantageously therefore, assembly of the outer body to the inner contact body is effected with particularly simple operations, and the design of both the outer body and the inner contact body require little material usage, whilst nevertheless providing a reliable contact.

Figure 17:
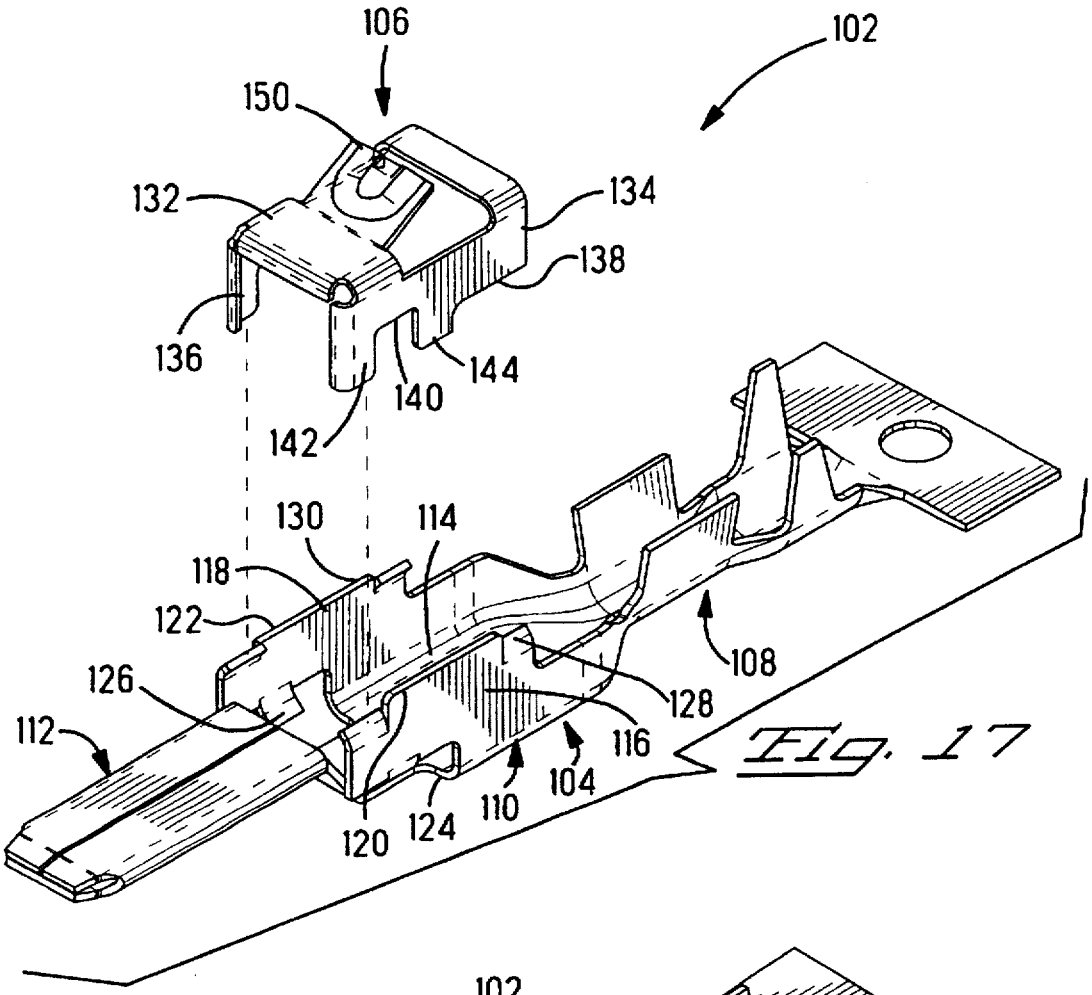
FIG. 17 is an isometric exploded view of a second embodiment of a two piece terminal according to this invention.
Figure 18:
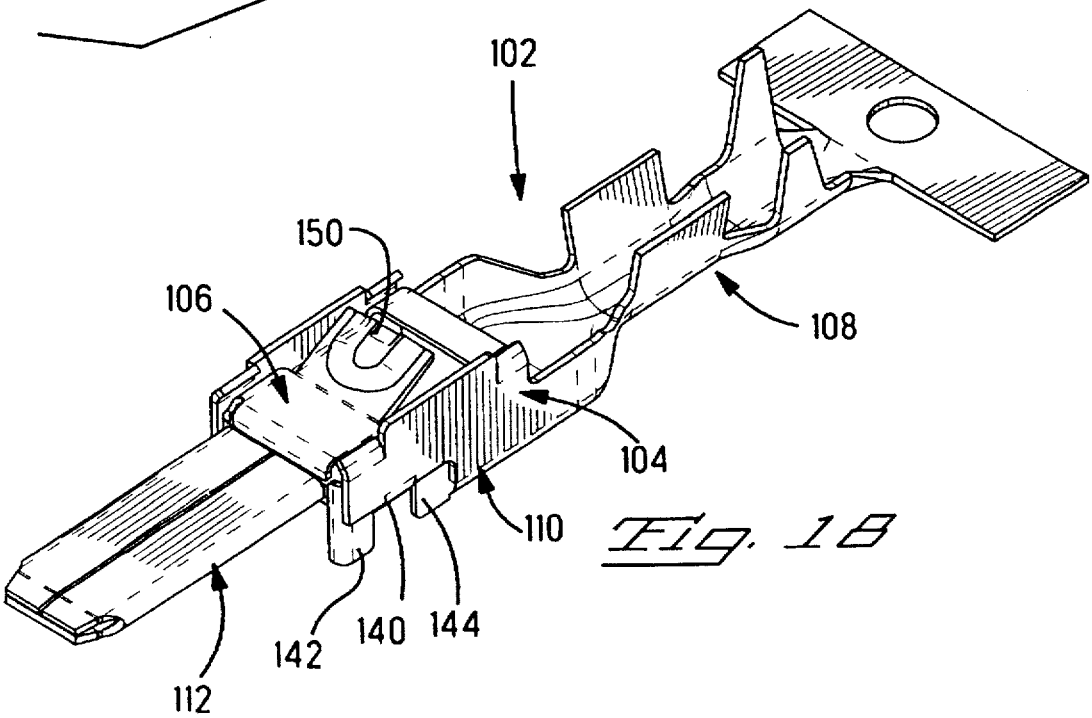
FIG. 18 is an isometric view of the second embodiment assembled.

Referring to FIGS. 17 and 18, a second embodiment of an electrical terminal 102 comprises an inner contact body 104 stamped and formed from sheet metal, and an outer body 106 also stamped and formed from sheet metal and comprising a locking lance 150.

The inner contact body 104 comprises a connection section 108 for crimping to a conducting wire, a body section 110, and a contact section 112 extending therefrom for mating with a complementary terminal. The body section 110 comprises a base wall 114 and side walls 116,118 extending orthogonally from lateral edges thereof, to free ends 120,122 that are at a top end 130 of the body section 110. The body section is provided with cutouts 124 that extend around the corner joining the side walls to the base wall and positioned proximate the contact section 112. Extending from the side wall 118 into the cutout 124 are lower retention tabs 126 that engage in a complementary slot 140 of the outer body. The side walls 116,118 are each provided with pairs of clinching tabs 128 that are deformed over the outer body 106 once assembled to the inner body.

The outer body 106 comprises a top wall 132 from which the locking lance 150 is stamped and formed, and side walls 134,136 extending from lateral edges of the top wall. The side walls 134,136 each have a lower edge 138 that has, proximate a contact section end, a slot 140 for receiving the lower tabs 126 of the inner contact body when mounted thereto. On either side of the slot 140 are extensions 142,144 that are received through the cutout 124 of the inner contact body for axial retention of the outer body to the inner body. The side walls 134 could also be provided with only one extension 144 received in a cutout without lower tabs 126. The lower tabs 126 can also be deformed (clinched) to clasp the outer contact body for a more robust assembly. The outer body side walls 134,136 are thus mounted against an inner side of the inner contact body side walls 116,118, whereby the clinching tabs of the inner contact body are then deformed over the outer body top wall 132 for secure retention of the outer body to the inner body.

The latter assembly movements are all performed in the vertical direction, thereby enabling particularly simple assembly of the outer body to the inner contact body, in particular as the vertical direction is the direction of movement of the stamping and forming tools (i.e. perpendicular to the original plane of the sheet metal from which the terminal is stamped and formed).

Figure 19:
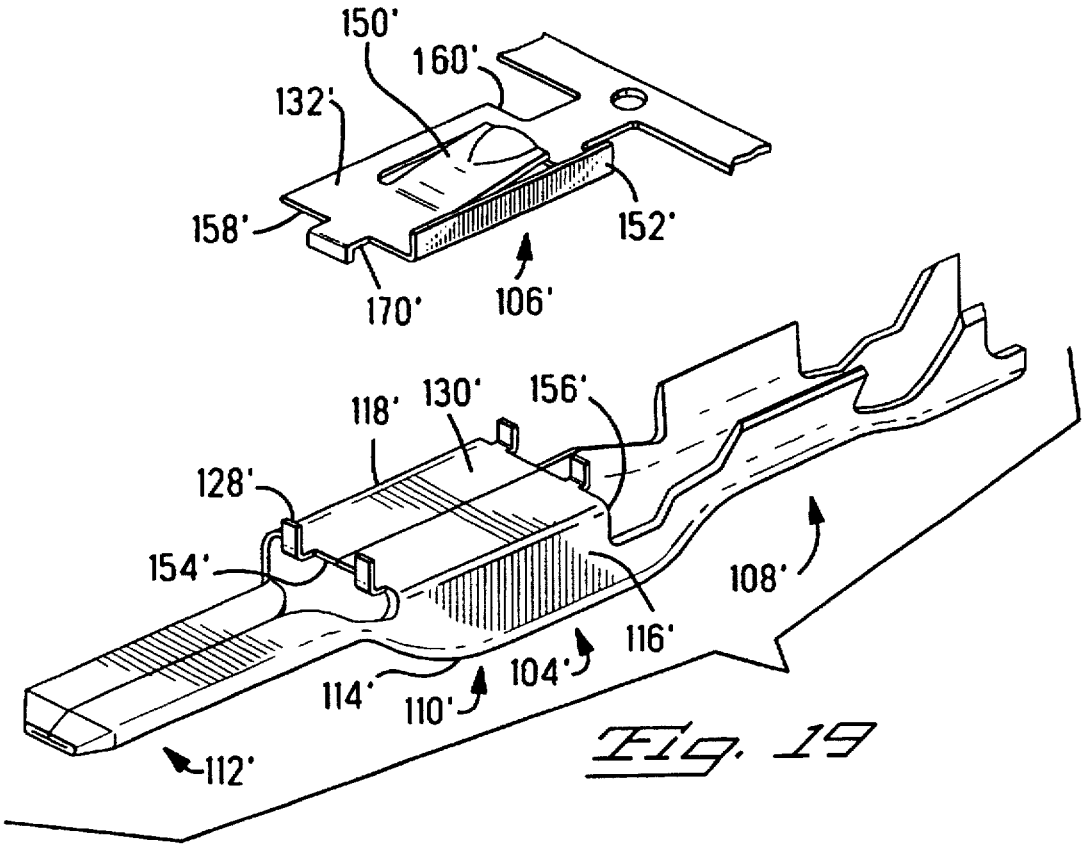
FIG. 19 is an exploded isometric view of a third embodiment of this invention.
Figure 20:
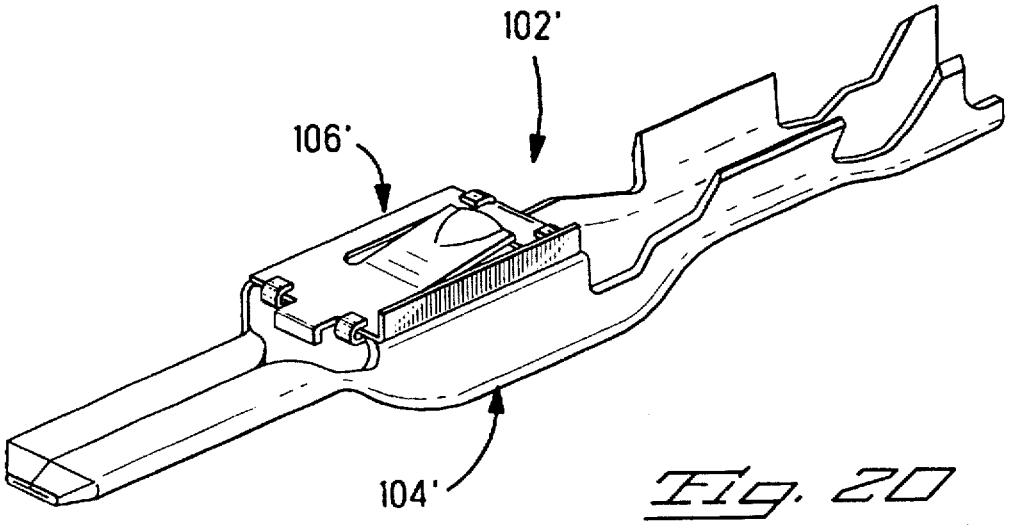
FIG. 20 is an isometric view of the fully assembled terminal of FIG. 19.

Referring now to FIGS. 19 and 20, a third embodiment of this invention is shown, comprising an inner contact body 104' having a connection section 108', a body section 110' and a contact section 112'. The body section 110' comprises a base wall 114', side walls 116',118' and a top wall 130'. An outer spring body 106' comprises a top wall 132' from which is stamped and formed a locking lance 150' and a polarizing member 152' that serves to polarize the terminal with respect to a cavity of a connector housing. The polarizing member 152' also provides protection for the locking lance 150' to prevent entanglement with foreign objects such as wires.

The top wall 132' of the outer body is mountable against the top wall 130' of the inner contact body section 110' and fixable thereto by clinching tabs 128' that extend at a mating end 154' and connection end 156' of the top wall 130' for folding over a mating end edge and connection end edge 158',160' respectively of the outer body 106'. A bent tab 170' extending from the top wall 132' is positioned between the pair of mating end clinching tabs 128' of the inner contact body to securely retain the outer body to the inner body with respect to sideways sliding movement. A similar such tab can be provided at the connection end.

The latter design thus allows assembly of the outer body to the inner body by vertical movement (perpendicular to the plane of the top wall 130' which is the direction of movement of the stamping and forming tools) thereby allowing easy and rapid assembly of the two parts. Furthermore, the outer body has low material usage in comparison to an outer body that is wrapped around the inner contact body.

Advantageously therefore, an easy to assemble two part terminal is provided ensuring particularly cost-effective manufacturing thereof.

Figure 21:
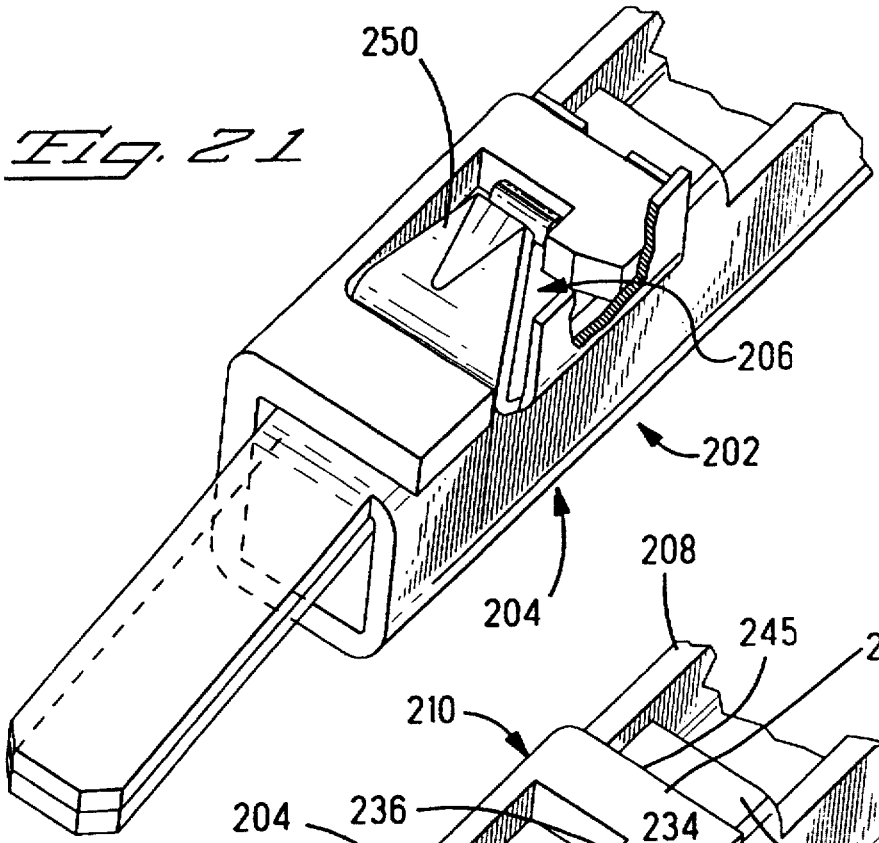
FIG. 21 is an isometric view of a fourth embodiment of a terminal according to this invention.
Figure 22:
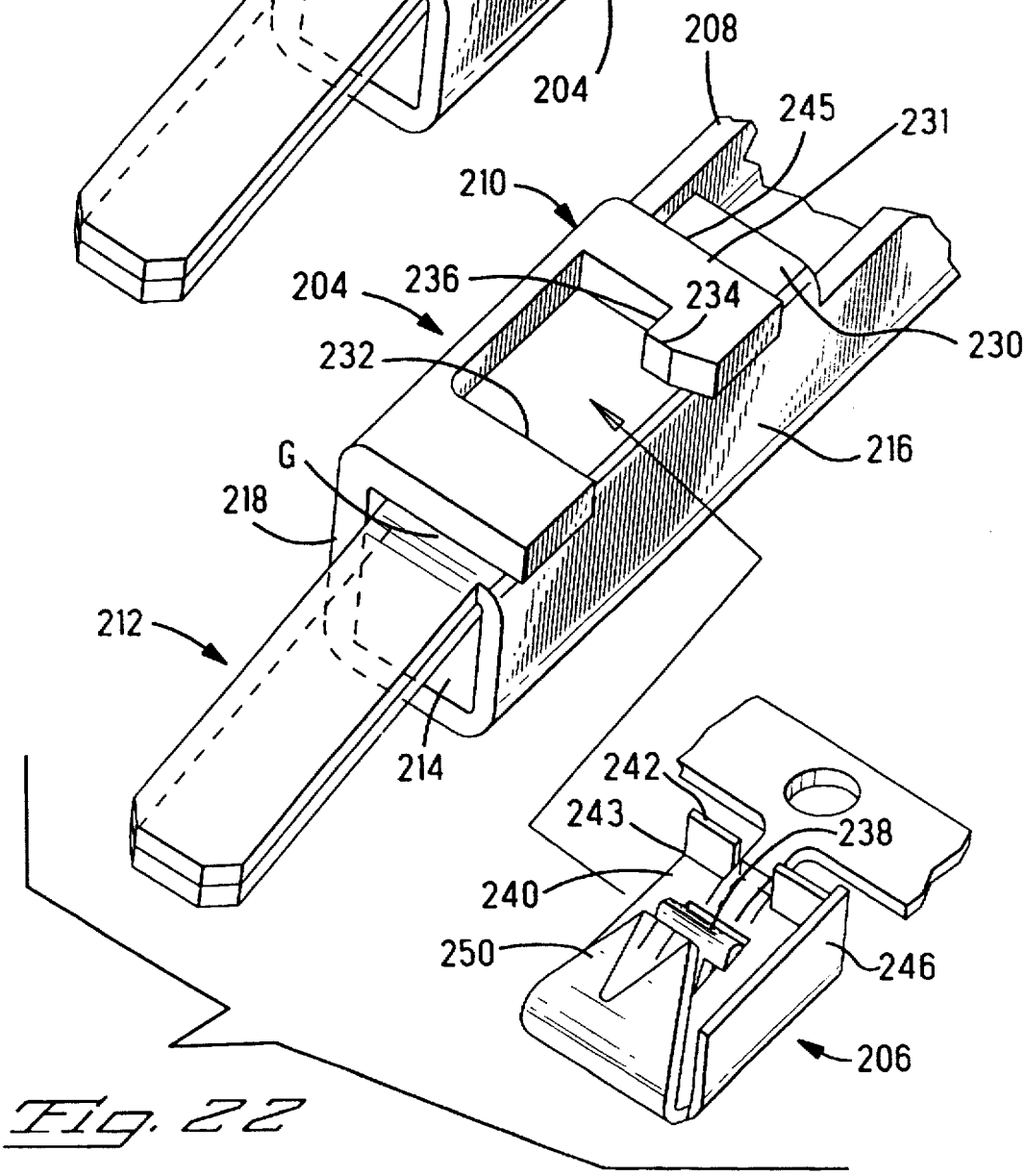
FIG. 22 is an isometric exploded view of the terminal of FIG. 21.
Figure 24:
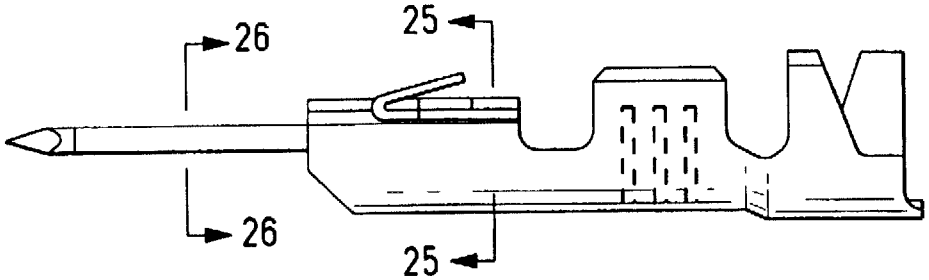
FIG. 24 is a view in the direction of arrow 24 of FIG. 23.

Referring to FIGS. 21–22, a fourth embodiment of an electrical terminal 202 comprises an inner contact body 204 and an outer body 206 having a locking lance 250. Referring to FIG. 22, the inner contact body 204 comprises a connection section 208 for connection to a conducting wire, a body section 210 and a contact section 212 extending therefrom for connection to a complementary terminal. The body section 210 comprises a base wall 214, side walls 216,218 extending orthogonally from lateral edges thereof, and a lower top wall 230 extending from one side wall 216, being overlapped by an upper top wall 231 extending from the other side wall 218. The upper top wall 231 comprises a cutout 232 extending from a free edge 233 of the upper top wall that is positioned proximate the plane of the side wall 216. The cutout 232 comprises a latching protrusion 234 having a latching shoulder 236 for engaging a latching member 238 of the outer body. The upper top wall 231 is separated from the lower top wall 230 by a certain gap G that allows insertion of a base wall 240 of the outer body 206 therebetween.

The outer body 206 comprises the base wall 240 from which the locking lance 250 extends outwardly and obliquely, further comprising the resilient latching member 238 that is stamped from the base wall in the shape of a cantilever beam for locking behind the shoulder 236 of the inner contact body. The outer body further comprises upwardly stamped tabs 242 extending from a connection end 243 of the base wall to engage behind a connection end 245 of the top wall 231. The outer body further comprises a polarizing extension 246 extending along an edge of the-base wall 240 for polarizing the terminal 202 with respect to a cavity of an electrical connector housing. The extension 246 also serves to protect the locking lance 250 from entanglement with foreign objects such as wires of a harness.

The outer body 206 is assembled to the inner contact body 204 by simply inserting the base wall 240 in the gap G between the upper and lower walls 231,230 respectively, until the latching arm 238 engages with the latching protrusion 234. A very rapid and simple assembly procedure is thus provided for lowering the manufacturing cost of the two part terminal. Furthermore, as the outer body 206 mounts substantially only against one wall of the terminal inner body, there is no material usage, in particular in comparison to an outer body that is wrapped around an inner contact body.

Figure 28:
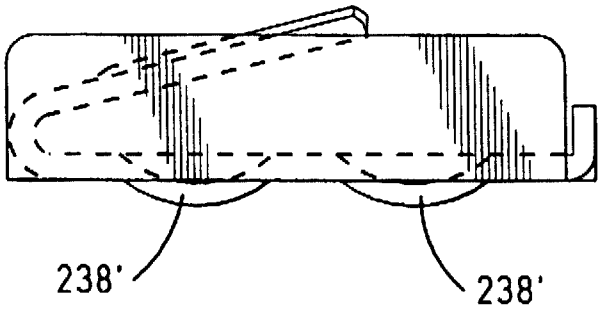
FIG. 28 is a side view of the outer body of FIG. 27.
Figure 27:
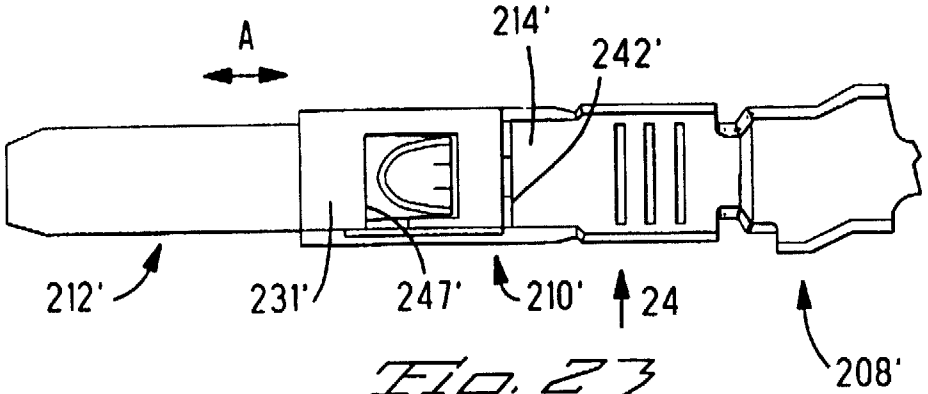
FIG. 27 is a front end view of an outer body of the fifth embodiment according to this invention.
Figure 26:
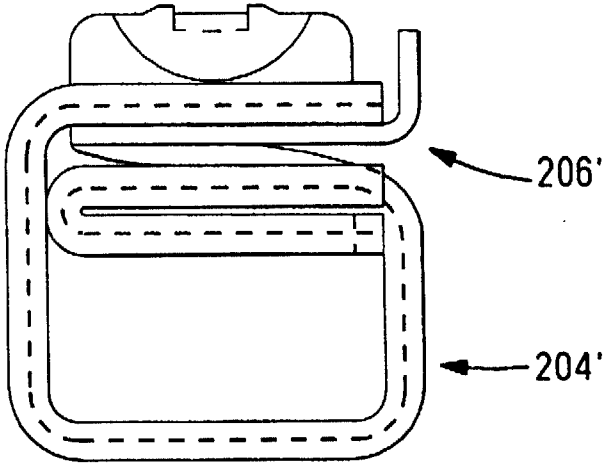
FIG. 26 is a cross-sectional view through lines 26—26 of FIG. 24.
Figure 25:
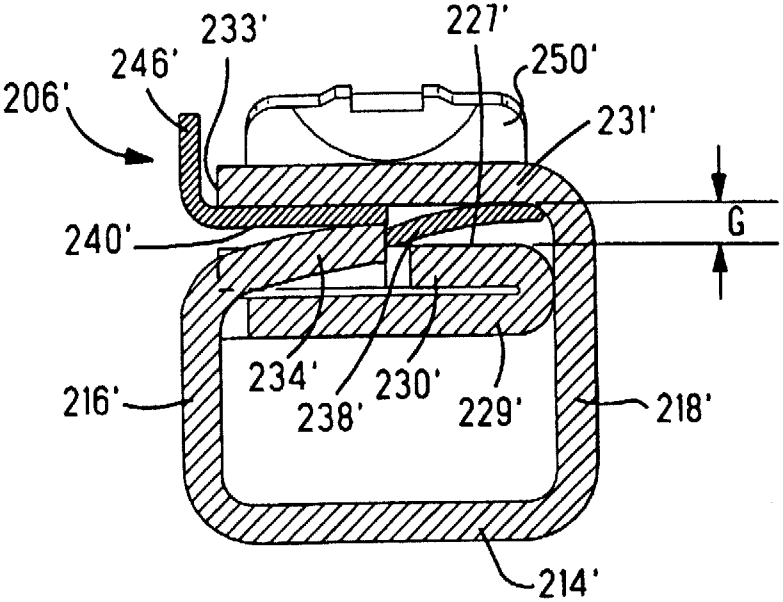
FIG. 25 is a cross-sectional view through lines 25—25 of FIG. 23.
Figure 27:
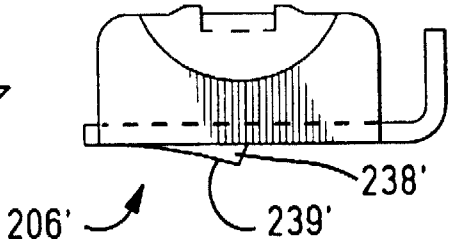

Referring now to FIGS. 23–28, a fifth embodiment of this invention is shown with an inner contact body 204' and an outer body 206' having a locking lance 250' thereon. The inner contact body comprises a connection section 208', a body section 210' and a contact section 212'. The body section 210' comprises a base wall 214' from which extend side walls 216',218'. From one side wall 216' extends a lower top wall 230' that is doubled over into an upper and lower layer 227',229' respectively. From the opposing side wall 218', extends an upper top wall 231' to a free edge 233' proximate the side wall 216'. A gap G is formed between the lower and upper top walls for receiving a base wall 240' of the outer body therebetween. The upper layer 227' of the lower top wall 230', comprises a resilient latch 234' stamped upwardly therefrom for engaging a corresponding latching shoulder 238' that is stamped downwardly from the base wall 240' of the outer body 206'. The latching shoulders 238' of the outer body are arcuately shaped as shown in FIG. 28 and have an oblique outer surface 239' (see FIG. 27) that allow smooth insertion of the outer body past the resilient latches 234'. The outer body 206' is also provided with a polarizing protrusion 246' that also serves to protect the locking lance 250' from damage and entanglement. A slot 247' in the upper top wall 231' is provided to allow passage of the locking lance 250' therethrough, and may further serve as a means for retaining the outer body 206' in the axial direction A which is the direction of possible pulling forces of a conductor on the terminal when mounted in a housing cavity. The outer body 206' may further be provided with retention tabs 242' that work in combination with the abutment of the mating end of the locking lance with the top wall cutout 247', to retain the outer body 206' axially with respect to the inner body.

Advantageously therefore, rapid assembly of the outer body to the inner body is enabled by simply inserting and latching the outer body in a gap provided between top walls of an inner contact body. Manufacturing costs are thereby reduced.

We claim:

1. An electrical terminal stamped and formed from sheet metal and comprising an outer body with a locking lance, and an inner contact body having a connection section for connection to a conducting wire, a body section, and a contact section extending therefrom for connection to a complementary terminal, the body section comprising a base wall and side walls extending upwardly therefrom to a top end, the outer body comprising a top wall mountable against the inner body top end and a side wall mountable against one of said side walls of the inner contact body, characterized in that the outer body side wall engages vertically in a gap that is formed by tabs extending alongside and spaced from the inner body side wall such that the outer body is mountable to the inner body by movement in the vertical direction, which is orthogonal to the mating direction of the terminal.

2. The terminal of claim 1 wherein the outer body comprises a second side wall mountable adjacent the opposing side wall of the inner body.

3. The terminal of claim 2 wherein the inner body side wall tabs are stamped out of the side wall.

4. The terminal of claim 2 wherein the outer body second side wail comprised a clinching tab extending from a lower end thereof, that is clinched through a cutout in the inner body, to the corresponding inner body side wall.

5. The terminal of claim 1 wherein one of said side walls of the inner body has a top wall portion extending progressively from a position proximate the connection section towards the contact section over the base wall to provide a top wall opposed to the base wall.

6. The terminal of claim 5 wherein the contact section comprises top and bottom walls attached together through a U-bend, the contact section top and bottom walls extending from the top and base wall respectively of the body section of the inner body.

* * * * *